US005362252A

United States Patent [19]

Lin

[11] Patent Number: 5,362,252

[45] Date of Patent: * Nov. 8, 1994

[54] MICROPHONE CONNECTOR

[75] Inventor: Jia S. Lin, Tainan, Taiwan, Prov. of China

[73] Assignee: New Tide Enterprises Co., Ltd., Tainan, Taiwan, Prov. of China

[ * ] Notice: The portion of the term of this patent subsequent to Aug. 9, 2011 has been disclaimed.

[21] Appl. No.: 151,230

[22] Filed: Nov. 12, 1993

Related U.S. Application Data

[63] Continuation-in-part of Ser. No. 047,953, Apr. 19, 1993.

[51] Int. Cl.[5] ..... H01R 13/59

[52] U.S. Cl. ..... 439/462

[58] Field of Search ..... 439/461, 462

[56] References Cited

U.S. PATENT DOCUMENTS 4,647,127 3/1987 Weingartner ..... 439/289
4,657,327 4/1987 Weingartner ..... 439/289

FOREIGN PATENT DOCUMENTS 172779 2/1986 European Pat. Off. ..... 439/461

*Primary Examiner*—Gary F. Paumen
*Attorney, Agent, or Firm*—Pro-Techtor International Services

[57] ABSTRACT

A microphone connector which includes a connector member, a connector housing engaging with the connector member by a female thread and a male thread to compress a cable put through the connector member and a cable pincher so that the cable bends a little along a curved surface of the cable pincher to be sufficiently pinched therein, not easily falling off or separating from the connector member.

6 Claims, 2 Drawing Sheets

MICROPHONE CONNECTOR

This application is a continuation-in-part of U.S. patent application Ser. No. 08/047,953 filed Apr. 19, 1993.

BACKGROUND OF THE INVENTION

Known microphone connectors of U.S. Pat. Nos. 4,647,127 and 4,657,327 have a cable pinching method wherein a ring 26 engages a connector member 13, forcing a tubular clamping sleeve 7 to open its rear end 8 for clamping a cable. However, the clamping sleeve is tubular, so a great force has to be used to engage a female thread of a terminal with a housing in clamping a large diameter cable in the clamping sleeve. And continuous work of using such a great force in assembling this kind of microphone connector may compel a worker to be extremely tired. The worker may feel pain or experience swelling of his right thumb after working to engage thirty or forty of those connectors, and has to stop his work.

SUMMARY OF THE INVENTION

This invention has an object to offer a microphone connector with features listed below.

1. It is provided with a cable pinched shaped to conform to a connector member.

2. The cable pincher has a pinching block with an upper surface shaped as recessed and curved for a cable to lie thereon closely bending up to be tightly pinched.

3. The pinching block has two pinching points on the outer end of the upper surface to stick in the surface of a cable to reinforce pinching of the cable.

DETAILED DESCRIPTION OF THE INVENTION

Figure 1:
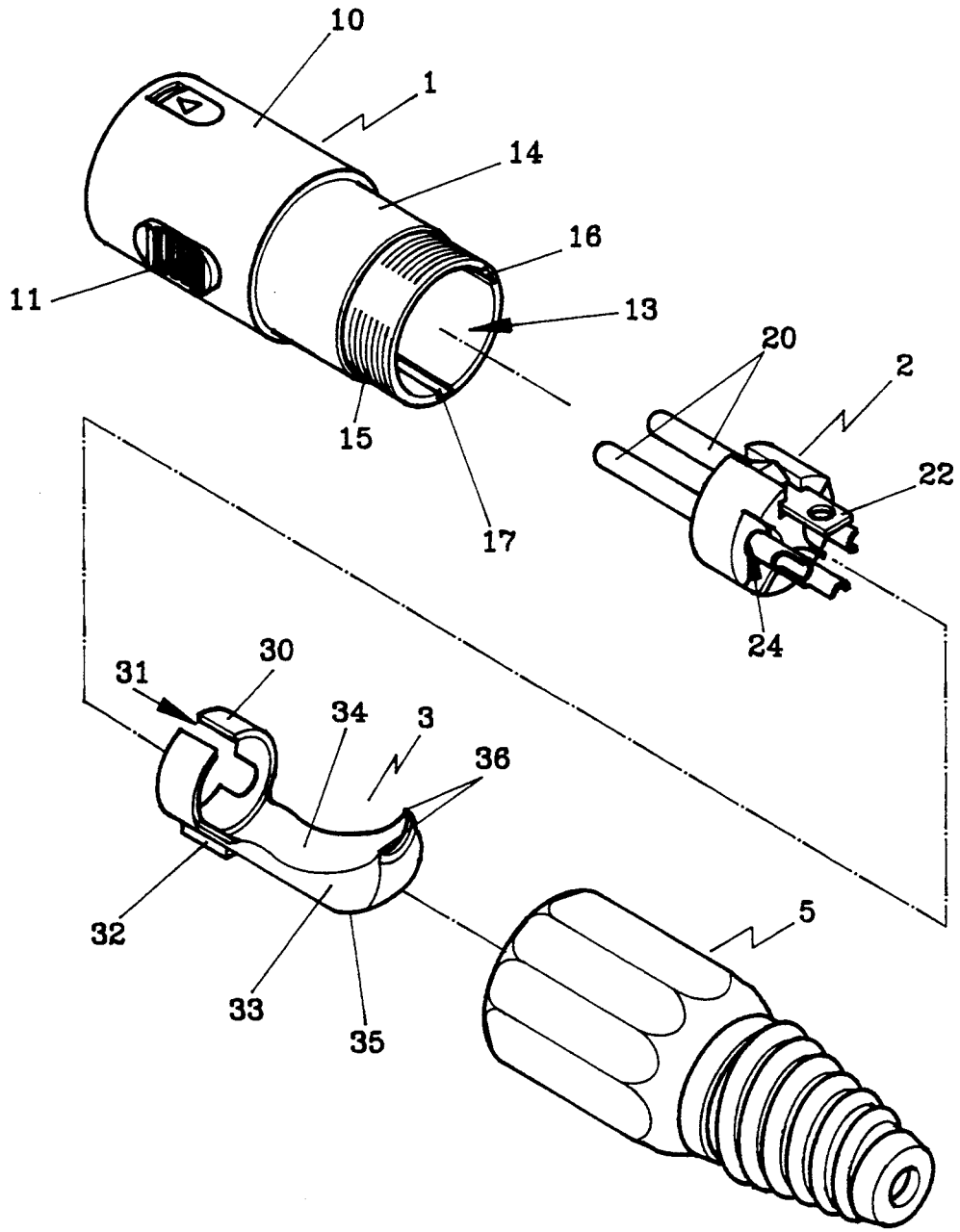
FIG. 1 is an exploded perspective view of a microphone connector in the present invention.
Figure 2:
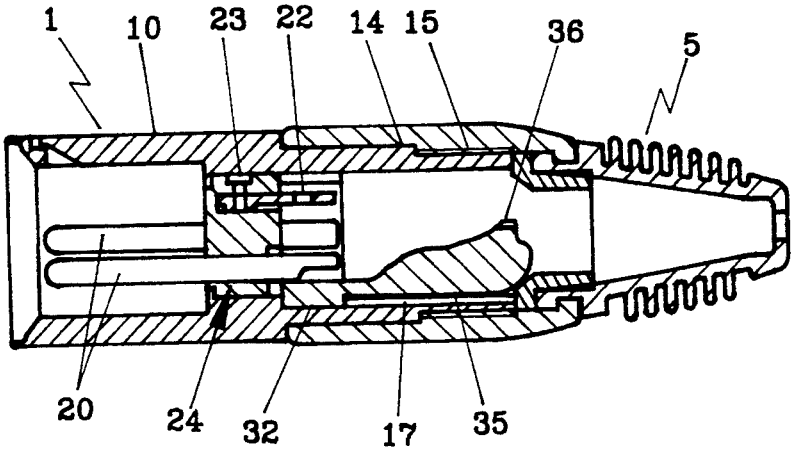
FIG. 2 is a cross-sectional view of the microphone connector in the present invention.

A male microphone connector in the present invention, as show in FIGS. 1–4, comprises a connector member 1, a terminal carrier 2, a cable pincher 3 and a connector housing 5 as main components.

The connector member 1 is shaped cylindrically, having a proximal hand holding surface portion 10 with two opposing grips 11 for a user to grip this connector, an intermediate smooth protion 14 and a distal male-threaded portion 15, an axially extending through hole 13 for depositing the terminal carrier 2 and the cable pincher 3 therein. For assembling with the connector housing 5, the intermediate smooth portion 14 is long and the distal male-threaded portion 15 is rather short so that the housing 5 may be screwed on with little force. Tow opposite axially extending grooves 16, 17 are provided in an inner surface of the hole 13 for the terminal carrier 2 and the cable pincher 3 to fit unrotatably straight in the hole 13.

The terminal carrier 2 is fitted in the through hole 13 of the connector member 1, having two terminals 20 to fit in terminal holes 24, a negative terminal 22 fixed on the carrier body with a bolt 23, and the end of each terminal is soldered with a wire of the cable 4.

Figure 3:
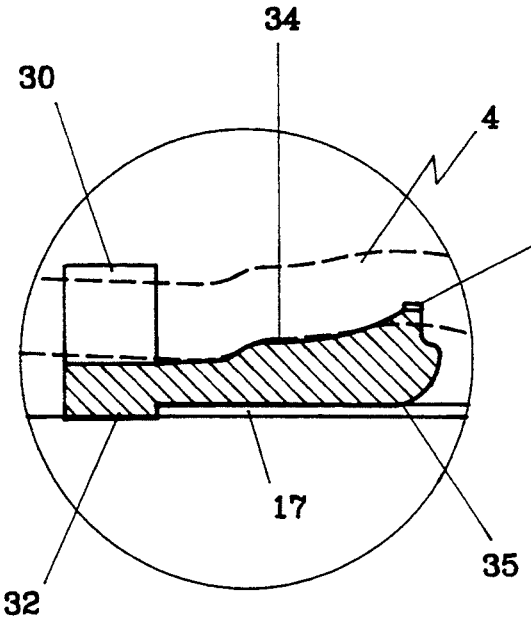
FIG. 3 is a magnified cross-sectional view of a cable pincher of the microphone connector in the present invention.
Figure 4:
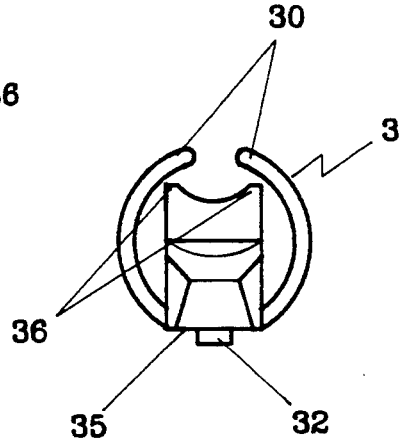
FIG. 4 is a rear view of the cable pincher of the microphone connector in the present invention.

The cable pincher 3 has an annular wall 30 with a slot 31 for pinching cables of various sizes therein, an engaging block 32 on the bottom of the wall 30 to engage with the groove 17 of the connector member 1, a pinching block 33 with an upper recessed and curved surface 34 and a curved-up end 35 and two pinching points 36 on the curved-up end 35. Therefore, after the cable 4 is put through the pincher 3, the connector housing 5 is screwed onto the connector member 1, by engaging the female-thread 50 with the male thread 15. Then the cable 4 can be bent up a little where there is a compact ring 51 in the connector housing 5, as shown in FIG. 3, after the cable 4 is placed through the cable pincher 3 and the connector housing 5 is screwed onto the connector member 1. In addition, the pinching points 36 stick in the outer surface of the cable 4, which then is difficult to pull off.

What is claimed is:

1. A microphone connector comprising:

a connector member shaped cylindrically, having at least a proximal hand holding portion, an intermediate smooth portion, a distal male-threaded portion to engage a female-threaded portion of a connector housing, and an axially extending through hole for depositing a terminal carrier and a cable pincher therein:

a terminal carrier shaped cylindrically to fit in the through hole of said connector member, having a number of terminal holes for terminals to pass through, said terminals having one end soldered with wires of a cable;

a connector housing having a female-threaded portion to engage the male-threaded portion of the connector member and a discrete compact ring on an inner surface of the connector housing;

a cable pincher having a slot for depositing a cable of various sizes through the slot, a pinching block extending lengthwise from the wall and having a recessed and curved surface and two pinching points on an outer end thereof, and upper and bottom surfaces gradually curving up to the outer end; and said compact ring in said connector housing compressing the upper surface of said cable pincher after the connector housing is combined with the connector member, said pinching points of the cable pincher then sticking in the surface of said cable and said cable being forced to bend up a little acording to the curvature of said pinching block of the cable pincher so that the cable pincher may sufficiently pinch the cable immovable and inseparable.

2. The microphone connector as claimed in claim 1, wherein said cable pincher is provided with a vertical semi-round wall to coordinate with a semi-round surface of said plug for pinching said cable.

3. The microphone connector as claimed in claim 1, wherein said cable pincher has a pinching block with an upper surface shaped as recessed and curved to conform to a round outer surface of said cable.

4. The microphone connector as claimed in claim 1, wherein said cable is compressed by said compact ring of the connector housing and said cable pincher bending inward slightly to be pinched very effectively.

5. The microphone connector as claimed in claim 1, wherein said proximal hand holding portion of the connector member has more than two grips.

6. The microphone connector as claimed in claim 1, wherein said intermediate smooth portion is longer than said distal male-threaded portion.

* * * * *